US007148187B1

(12) United States Patent
Simon et al.

(10) Patent No.: US 7,148,187 B1
(45) Date of Patent: Dec. 12, 2006

(54) LOW RESIDUE CLEANING COMPOSITION COMPRISING LACTIC ACID, NONIONIC SURFACTANT AND SOLVENT MIXTURE

(75) Inventors: Richard E. Simon, Oakland, CA (US); Lily Cheng, Oakland, CA (US); David L. DeLeeuw, Oakland, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 11/168,106

(22) Filed: Jun. 28, 2005

(51) Int. Cl.
*C11D 1/83* (2006.01)
*C11D 3/20* (2006.01)
*C11D 3/44* (2006.01)

(52) U.S. Cl. ..... 510/235; 510/253; 510/155; 510/238; 510/289; 510/290; 510/295; 510/342; 510/365; 510/371; 510/432; 510/421; 510/426; 510/438; 510/439

(58) Field of Classification Search ..... 510/253, 510/155, 235, 238, 289, 290, 295, 342, 365, 510/371, 432, 421, 426, 438, 439
See application file for complete search history.

(56) References Cited

U.S. PATENT DOCUMENTS

| | | | | |
|---|---|---|---|---|
| 4,530,781 | A * | 7/1985 | Gipp | 510/284 |
| 5,234,719 | A * | 8/1993 | Richter et al. | 427/384 |
| 5,356,479 | A * | 10/1994 | Menke et al. | 134/2 |
| 5,705,472 | A * | 1/1998 | Hayes et al. | 510/423 |
| 5,780,416 | A | 7/1998 | Kiewert et al. | 510/422 |
| 5,851,980 | A * | 12/1998 | Avery | 510/424 |
| 5,912,219 | A | 6/1999 | Carrie et al. | 510/238 |
| 5,912,220 | A * | 6/1999 | Sramek et al. | 510/284 |
| 5,998,358 | A * | 12/1999 | Herdt et al. | 510/506 |
| 6,087,319 | A * | 7/2000 | Norman | 510/466 |
| 6,197,738 | B1 | 3/2001 | Regutti | 510/383 |
| 6,210,695 | B1 | 4/2001 | Beerse et al. | 424/404 |
| 6,221,823 | B1 * | 4/2001 | Crisanti et al. | 510/238 |
| 6,239,092 | B1 | 5/2001 | Papasso et al. | 510/238 |
| 6,258,368 | B1 | 7/2001 | Beerse et al. | 424/404 |
| 6,281,189 | B1 | 8/2001 | Heimann et al. | 510/491 |
| 6,346,508 | B1 * | 2/2002 | Leonard et al. | 510/417 |
| 6,436,885 | B1 | 8/2002 | Biedermann et al. | 510/131 |
| 6,517,849 | B1 | 2/2003 | Seger et al. | 424/402 |
| 6,559,111 | B1 * | 5/2003 | Colurciello et al. | 510/238 |
| 6,613,728 | B1 | 9/2003 | Sirianni et al. | 510/382 |
| 6,617,290 | B1 | 9/2003 | Lopes | 510/111 |
| 6,689,223 | B1 * | 2/2004 | Meine et al. | 134/2 |
| 6,699,825 | B1 | 3/2004 | Rees et al. | 510/180 |
| 6,701,940 | B1 | 3/2004 | Tsibouklis et al. | 134/25.2 |
| 6,740,626 | B1 * | 5/2004 | Neumiller | 510/109 |
| 6,758,411 | B1 * | 7/2004 | Conway et al. | 239/303 |
| 6,794,346 | B1 * | 9/2004 | Wick et al. | 510/238 |
| 6,812,196 | B1 | 11/2004 | Rees et al. | 510/238 |
| 6,841,090 | B1 * | 1/2005 | Serego Allighieri et al. | 252/186.1 |
| 6,849,586 | B1 * | 2/2005 | Avery et al. | 510/191 |
| 6,867,233 | B1 | 3/2005 | Roselle et al. | 514/557 |
| 2002/0031966 | A1 * | 3/2002 | Tomarchio et al. | 442/218 |
| 2002/0132742 | A1 * | 9/2002 | Mizuki | 510/111 |
| 2003/0096722 | A1 | 5/2003 | Caselli et al. | 510/382 |
| 2003/0143909 | A1 * | 7/2003 | Bamabas et al. | 442/123 |
| 2003/0235550 | A1 | 12/2003 | Pan et al. | 424/70.16 |
| 2004/0048755 | A1 | 3/2004 | Lopes | 510/111 |
| 2005/0155630 | A1 * | 7/2005 | Kilkenny et al. | 134/6 |

FOREIGN PATENT DOCUMENTS

| | | | |
|---|---|---|---|
| WO | 00/00026 | * | 1/2000 |
| WO | WO00/00026 | | 1/2000 |
| WO | WO00/63337 | | 10/2000 |
| WO | WO2004/018599 | | 3/2004 |

* cited by examiner

*Primary Examiner*—Charles Boyer
(74) *Attorney, Agent, or Firm*—David Peterson

(57) ABSTRACT

A cleaning composition with a 2-hydroxycarboxylic acid and a nonionic surfactant gives good antimicrobial performance and good filming and streaking performance. The composition can contain a solvent with low water solubility, a volatile solvent that is miscible in water, and additional surfactants. The nonionic surfactant can be food safe. The composition can be impregnated and used on a wipe or other substrate.

16 Claims, No Drawings

LOW RESIDUE CLEANING COMPOSITION COMPRISING LACTIC ACID, NONIONIC SURFACTANT AND SOLVENT MIXTURE

BACKGROUND OF THE INVENTION

1. Field of the Invention

The present invention relates generally to cleaning compositions for use on hard surfaces. The invention also relates to cleaning compositions for use with cleaning substrates, cleaning heads, cleaning pads, cleaning sponges and related systems for cleaning hard surfaces. The composition also relates to acidic cleaning compositions with low residue.

2. Description of the Related Art

U.S. Pat. No. 6,699,825 to Rees et al. discloses low residue antimicrobial cleaners with low concentrations of organic acid, glycols, and solvents with less than 10% water solubility. U.S. Pat. No. 6,812,196 to Rees et al. discloses antimicrobial cleaners with solvents of low volatility. PCT Pat. App. WO2004/018599 to McCue et al. discloses antimicrobial cleaners with mixtures of anionic and nonionic surfactants.

Prior art compositions do not combine disinfection and low residue, especially with food safe ingredients. It is therefore an object of the present invention to provide a cleaning composition that overcomes the disadvantages and shortcomings associated with prior art cleaning compositions.

SUMMARY OF THE INVENTION

In accordance with the above objects and those that will be mentioned and will become apparent below, one aspect of the present invention comprises a hard surface cleaning composition comprising:

a. greater than 1% by weight 2-hydroxycarboxylic acid;
b. 0 to 10% by weight anionic surfactant;
c. 0.1 to 10% by weight nonionic surfactant; and
d. 0.1 to 10% by weight of a solvent with less than 20% solubility in water;
e. wherein the ratio of anionic surfactant to nonionic surfactant is less than 0.5.

In accordance with the above objects and those that will be mentioned and will become apparent below, another aspect of the present invention comprises a cleaning composition comprising:

a. 1 to 20% by weight lactic acid;
b. 0.1 to 10% by weight of a nonionic surfactant, wherein said nonionic surfactant is food safe; and
c. 0 to 10% by weight of an additional surfactant selected from the group consisting of anionic, cationic, ampholytic, amphoteric and zwitterionic surfactants and combinations thereof;
d. wherein the ratio of said additional surfactants to said nonionic surfactant is less than 0.5.

In accordance with the above objects and those that will be mentioned and will become apparent below, another aspect of the present invention comprises a cleaning substrate impregnated with a cleaning composition comprising a. 1 to 10% by weight lactic acid;
b. 0.1 to 10% by weight of a nonionic surfactant; and
c. 0 to 10% by weight of an additional surfactant selected from the group consisting of anionic, cationic, ampholytic, amphoteric and zwitterionic surfactants and combinations thereof;
d. wherein the ratio of said additional surfactants to said nonionic surfactant is less than 0.5.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The cleaning composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

As used herein, the term "substrate" is intended to include any material that is used to clean an article or a surface. Examples of cleaning substrates include, but are not limited to nonwovens, sponges, films and similar materials which can be attached to a cleaning implement, such as a floor mop, handle, or a hand held cleaning tool, such as a toilet cleaning device.

As used herein, "film" refers to a polymer film including flat nonporous films, and porous films such as microporous, nanoporous, closed or open celled, breathable films, or apertured films.

As used herein, "wiping" refers to any shearing action that the substrate undergoes while in contact with a target surface. This includes hand or body motion, substrate-implement motion over a surface, or any perturbation of the substrate via energy sources such as ultrasound, mechanical vibration, electromagnetism, and so forth.

As used herein, the term "fiber" includes both staple fibers, i.e., fibers which have a defined length between about 2 and about 20 mm, fibers longer than staple fiber but are not continuous, and continuous fibers, which are sometimes called "continuous filaments" or simply "filaments". The method in which the fiber is prepared will determine if the fiber is a staple fiber or a continuous filament.

As used herein, the terms "nonwoven" or "nonwoven web" means a web having a structure of individual fibers or threads which are interlaid, but not in an identifiable manner as in a knitted web. Nonwoven webs have been formed from many processes, such as, for example, meltblowing processes, spunbonding processes, and bonded carded web processes.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "sponge", as used herein, is meant to mean an elastic, porous material, including, but not limited to, compressed sponges, cellulosic sponges, reconstituted cellulosic sponges, cellulosic materials, foams from high internal phase emulsions, such as those disclosed in U.S. Pat. No. 6,525,106, polyethylene, polypropylene, polyvinyl alcohol, polyurethane, polyether, and polyester sponges, foams and nonwoven materials, and mixtures thereof.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

2-Hydroxycarboxylic Acids

One aspect of the invention is a 2-hydroxycarboxylic acid. Examples of 2-hydroxycarboxylic acids are given in Table I. 2-Hydroxycarboxylic acids also include polymeric forms of 2-hydroxycarboxylic acid, such as polylactic acid. Suitable compositions comprise 2-hydroxycarboxylic acids in concentrations of 1 to 50% by weight, or 1 to 20% by weight, or 1 to 10% by weight. Table I

TABLE I

| 2-Hydroxyacids | | MP ° C. |
|---|---|---|
| Tartaric acid | 2,3-dihydroxy succinic acid | 170 |
| Citric acid | 2-hydroxy propanetricarboxylic acid | 153 |
| Malic acid | 2-hydroxy succinic acid | 128 |

TABLE I-continued

| 2-Hydroxyacids | | MP ° C. |
|---|---|---|
| Mandelic acid | 2-hydroxy phenylacetic acid | 117 |
| Glycolic acid | 2-hydroxy acetic acid | 78 |
| Lactic acid | 2-hydroxy propionic acid | 18 |

Nonionic Surfactant

One aspect of the invention is a nonionic surfactant. Suitable nonionic surfactants can be found in U.S. Pat. No. 3,929,678 to Laughlin et al. Essentially any alkoxylated nonionic surfactants are suitable herein, for instance, ethoxylated and propoxylated nonionic surfactants. Alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Also suitable are the condensation products of alcohols having an alkyl group containing from 8 to 20 carbon atoms with from 2 to 10 moles of ethylene oxide per mole of alcohol.

Polyhydroxy fatty acid amides suitable for use herein are those having the structural formula $R^2CONR^1Z$ wherein: $R^1$ is H, C1–C4 hydrocarbyl, 2-hydroxyethyl, 2-hydroxypropyl, ethoxy, propoxy, or a mixture thereof, for instance, C1–C4 alkyl, or C1 or C2 alkyl; and $R^2$ is a C5–C31 hydrocarbyl, for instance, straight-chain C5–C19 alkyl or alkenyl, or straight-chain C9–C17 alkyl or alkenyl, or straight-chain C11–C17 alkyl or alkenyl, or mixture thereof-, and Z is a polyhydroxyhydrocarbyl having a linear hydrocarbyl chain with at least 3 hydroxyls directly connected to the chain, or an alkoxylated derivative (for example, ethoxylated or propoxylated) thereof. Z may be derived from a reducing sugar in a reductive amination reaction, for example, Z is a glycityl.

Suitable fatty acid amide surfactants include those having the formula: $R^1CON(R^2)_2$ wherein $R^1$ is an alkyl group containing from 7 to 21, or from 9 to 17 carbon atoms and each $R^2$ is selected from the group consisting of hydrogen, C1–C4 alkyl, C1–C4 hydroxyalkyl, and $—(C_2H_4O)_xH$, where x is in the range of from 1 to 3.

Suitable alkylpolysaccharides for use herein are disclosed in U.S. Pat. No. 4,565,647 to Llenado, having a hydrophobic group containing from 6 to 30 carbon atoms and a polysaccharide, e.g., a polyglycoside, hydrophilic group containing from 1.3 to 10 saccharide units. Alkylpolyglycosides may have the formula: $R^2O(C_nH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl may be derived from glucose.

Other suitable nonionic surfactants are food safe nonionic surfactants. Examples of food safe nonionic surfactants are sucrose esters, such as sucrose cocoate available from Croda, and sorbitan esters, such as polyoxyethylene(20) sorbitan monooleate from J. T. Baker and polyoxyethylene (20)sorbitan monolaurate from Uniquema. Other examples of food safe nonionic surfactants are given in Generally Recognized As Safe (GRAS) lists, as described below.

The nonionic surfactants may be present at a level of from about 0% to 90%, or from about 0.001% to 50%, or from about 0.01% to 25% by weight.

Additional Surfactants

The cleaning composition may contain one or more additional surfactants selected from anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, anionic, ampholytic, amphotenic and zwitteronic surfactants are generally used in combination with one or more nonionic surfactants. The surfactants may be present at a level of from about 0% to 90%, or from about 0.001% to 50%, or from about 0.01% to 25% by weight.

The cleaning composition may comprise an anionic surfactant. Essentially any anionic surfactants useful for detersive purposes can be used in the cleaning composition. These can include salts (including, for example, sodium, potassium, ammonium, and substituted ammonium salts such as mono-, di- and tri-ethanolamine salts) of the anionic sulfate, sulfonate, carboxylate and sarcosinate surfactants. Anionic surfactants may comprise a sulfonate or a sulfate surfactant. Anionic surfactants may comprise an alkyl sulfate, a linear or branched alkyl benzene sulfonate, or an alkyldiphenyloxide disulfonate, as described herein.

Other anionic surfactants include the isethionates such as the acyl isethionates, N-acyl taurates, fatty acid amides of methyl tauride, alkyl succinates and sulfosuccinates, monoesters of sulfosuccinate (for instance, saturated and unsaturated C12–C18 monoesters) diesters of sulfosuccinate (for instance saturated and unsaturated C6–C14 diesters), N-acyl sarcosinates. Resin acids and hydrogenated resin acids are also suitable, such as rosin, hydrogenated rosin, and resin acids and hydrogenated resin acids present in or derived from tallow oil. Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the C5–C17acyl-N—(C1–C4 alkyl) and —N—(C1–C2 hydroxyalkyl) glucamine sulfates, and sulfates of alkylpolysaccharides such as the sulfates of alkylpolyglucoside (the nonionic nonsulfated compounds being described herein). Alkyl sulfate surfactants may be selected from the linear and branched primary C10–C18 alkyl sulfates, the C11–C15 branched chain alkyl sulfates, or the C12–C14 linear chain alkyl sulfates.

Alkyl ethoxysulfate surfactants may be selected from the group consisting of the C10–C18 alkyl sulfates, which have been ethoxylated with from 0.5 to 20 moles of ethylene oxide per molecule. The alkyl ethoxysulfate surfactant may be a C11–C18, or a C11–C15 alkyl sulfate which has been ethoxylated with from 0.5 to 7, or from 1 to 5, moles of ethylene oxide per molecule. One aspect of the invention employs mixtures of the alkyl sulfate and/or sulfonate and alkyl ethoxysulfate surfactants. Such mixtures have been disclosed in PCT Patent Application No. WO 93/18124.

Anionic sulfonate surfactants suitable for use herein include the salts of C5–C20 linear alkylbenzene sulfonates, alkyl ester sulfonates, C6–C22 primary or secondary alkane sulfonates, C6–C24 olefin sulfonates, sulfonated polycarboxylic acids, alkyl glycerol sulfonates, fatty acyl glycerol sulfonates, fatty oleyl glycerol sulfonates, and any mixtures thereof. Suitable anionic carboxylate surfactants include the alkyl ethoxy carboxylates, the alkyl polyethoxy polycarboxylate surfactants and the soaps ('alkyl carboxyls'), especially certain secondary soaps as described herein. Suitable alkyl ethoxy carboxylates include those with the formula $RO(CH_2CH_2O)_xCH_2COO^-M^+$ wherein R is a C6 to C18 alkyl group, x ranges from 0 to 10, and the ethoxylate distribution is such that, on a weight basis, the amount of material where x is 0 is less than 20% and M is a cation. Suitable alkyl polyethoxypolycarboxylate surfactants include those having the formula $RO—(CHR^1—CHR^2—O)—R^3$ wherein R is a C6 to C18 alkyl group, x is from 1 to 25, $R^1$ and $R^2$ are selected from the group consisting of hydrogen, methyl acid radical, succinic acid radical, hydroxysuccinic acid radical, and mixtures thereof, and $R^3$ is selected from the group consisting of hydrogen, substituted or unsubstituted hydrocarbon having between 1 and 8 carbon atoms, and mixtures thereof.

Suitable soap surfactants include the secondary soap surfactants, which contain a carboxyl unit connected to a secondary carbon. Suitable secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Other suitable anionic surfactants are the alkali metal sarcosinates of formula $R—CON(R^1)CH—)COOM$, wherein R is a C5–C17 linear or branched alkyl or alkenyl group, $R^1$ is a C1–C4 alkyl group and M is an alkali metal ion. Examples are the myristyl and oleoyl methyl sarcosinates in the form of their sodium salts.

Suitable amphoteric surfactants for use herein include the amine oxide surfactants and the alkyl amphocarboxylic acids. Suitable amine oxides include those compounds having the formula $R^3(OR^4)_xNO(R^5)_2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof, x is from 0 to 5, preferably from 0 to 3; and each $R^5$ is an alkyl or hydroxyalkyl group containing from 1 to 3, or a polyethylene oxide group containing from 1 to 3 ethylene oxide groups. Suitable amine oxides are C10–C18 alkyl dimethylamine oxide, and C10–18 acylamido alkyl dimethylamine oxide. A suitable example of an alkyl amphodicarboxylic acid is Miranol(™) C2M Conc. manufactured by Miranol, Inc., Dayton, N.J.

Zwitterionic surfactants can also be incorporated into the cleaning compositions. These surfactants can be broadly described as derivatives of secondary and tertiary amines, derivatives of heterocyclic secondary and tertiary amines, or derivatives of quaternary ammonium, quaternary phosphoniurn or tertiary sulfonium compounds. Betaine and sultaine surfactants are exemplary zwittenionic surfactants for use herein.

Suitable betaines are those compounds having the formula $R(R^1)_2N^+R^2COO^-$ wherein R is a C6–C18 hydrocarbyl group, each $R^1$ is typically C1–C3 alkyl, and $R^2$ is a C1–C5 hydrocarbyl group. Suitable betaines are C12–18 dimethylammonio hexanoate and the C10–18 acylamidopropane (or ethane) dimethyl (or diethyl) betaines. Complex betaine surfactants are also suitable for use herein.

Suitable cationic surfactants to be used herein include the quaternary ammonium surfactants. The quaternary ammonium surfactant may be a mono C6–C16, or a C6–C 10 N-alkyl or alkenyl ammonium surfactant wherein the remaining N positions are substituted by methyl, hydroxyethyl or hydroxypropyl groups. Suitable are also the mono-alkoxylated and bis-alkoxylated amine surfactants.

Another suitable group of cationic surfactants, which can be used in the cleaning compositions, are cationic ester surfactants. The cationic ester surfactant is a compound having surfactant properties comprising at least one ester (i.e. —COO—) linkage and at least one cationically charged group. Suitable cationic ester surfactants, including choline ester surfactants, have for example been disclosed in U.S. Pat. Nos. 4,228,042, 4,239,660 and 4,260,529. The ester linkage and cationically charged group may be separated from each other in the surfactant molecule by a spacer group consisting of a chain comprising at least three atoms (i.e. of three atoms chain length), or from three to eight atoms, or from three to five atoms, or three atoms. The atoms forming the spacer group chain are selected from the group consisting, of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—, $CH_2$— and —$CH_2$—NH—$CH_2$— linkages are included. The spacer group chain may comprise only carbon atoms, or the chain is a hydrocarbyl chain.

The cleaning composition may comprise cationic mono-alkoxylated amine surfactants, for instance, of the general formula: $R^1R^2R^3N^+ApR^4X^-$ wherein $R^1$ is an alkyl or alkenyl moiety containing from about 6 to about 18 carbon atoms, or from 6 to about 16 carbon atoms, or from about 6 to about 14 carbon atoms; $R^2$ and $R^3$ are each independently alkyl groups containing from one to about three carbon atoms, for instance, methyl, for instance, both $R^2$ and $R^3$ are methyl groups; $R^4$ is selected from hydrogen, methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, or from 2 to about 15, or from 2 to about 8. The $ApR^4$ group in the formula may have p=1 and is a hydroxyalkyl group, having no greater than 6 carbon atoms whereby the —OH group is separated from the quaternary ammonium nitrogen atom by no more than 3 carbon atoms. Suitable $ApR^4$ groups are —$CH_2CH_2$—OH, —$CH_2CH_2CH_2$—OH, —$CH_2CH(CH_3)$—OH and —$CH(CH_3)CH_2$—OH. Suitable $R^1$ groups are linear alkyl groups, for instance, linear $R^1$ groups having from 8 to 14 carbon atoms.

Suitable cationic mono-alkoxylated amine surfactants for use herein are of the formula $R^1(CH_3)(CH_3)N^+(CH_2CH_2O)_{2-5}H\ X^-$ wherein $R^1$ is C10–C18 hydrocarbyl and mixtures thereof, especially C10–C14 alkyl, or C10 and C12 alkyl, and X is any convenient anion to provide charge balance, for instance, chloride or bromide.

As noted, compounds of the foregoing type include those wherein the ethoxy ($CH_2CH_2O^-$) units (EO) are replaced by butoxy, isopropoxy [$CH(CH_3)CH_2O$] and [$CH_2CH(CH_3)O$] units (i-Pr) or n-propoxy units (Pr), or mixtures of EO and/or Pr and/or i-Pr units.

The cationic bis-alkoxylated amine surfactant may have the general formula: $R^1R^2N^+\ ApR^3A'qR^4X^-$ wherein $R^1$ is an alkyl or alkenyl moiety containing from about 8 to about 18 carbon atoms, or from 10 to about 16 carbon atoms, or from about 10 to about 14 carbon atoms; $R^2$ is an alkyl group containing from one to three carbon atoms, for instance, methyl; $R^3$ and $R^4$ can vary independently and are selected from hydrogen, methyl and ethyl, $X^-$ is an anion such as chloride, bromide, methylsulfate, sulfate, or the like, sufficient to provide electrical neutrality. A and A' can vary independently and are each selected from C1–C4 alkoxy, for instance, ethoxy, (i.e., —$CH_2CH_2O$—), propoxy, butoxy and mixtures thereof, p is from 1 to about 30, or from 1 to about 4 and q is from 1 to about 30, or from 1 to about 4, or both p and q are 1.

Suitable cationic bis-alkoxylated amine surfactants for use herein are of the formula $R^1CH_3N^+(CH_2CH_2OH)(CH_2CH_2OH)\ X^-$, wherein $R^1$ is C10–C18 hydrocarbyl and mixtures thereof, or C10, C12, C14 alkyl and mixtures thereof, $X^-$ is any convenient anion to provide charge balance, for example, chloride. With reference to the general cationic bis-alkoxylated amine structure noted above, since in one example compound $R^1$ is derived from (coconut) C12–C14 alkyl fraction fatty acids, $R^2$ is methyl and $ApR^3$ and $A'qR^4$ are each monoethoxy.

Other cationic bis-alkoxylated amine surfactants useful herein include compounds of the formula: $R^1R^2N^+$—$(CH_2CH_2O)_pH$—$(CH_2CH_2O)_qH\ X^-$ wherein $R^1$ is C10–C18 hydrocarbyl, or C10–C14 alkyl, independently p is 1 to about 3 and q is 1 to about 3, $R^2$ is C1–C3 alkyl, for example, methyl, and $X^-$ is an anion, for example, chloride or bromide.

Other compounds of the foregoing type include those wherein the ethoxy ($CH_2CH_2O$) units (EO) are replaced by butoxy (Bu)isopropoxy [$CH(CH_3)CH_2O$] and [$CH_2CH(CH_3)O$] units (i-Pr) or n-propoxy units (Pr), or mixtures of EO and/or Pr and/or i-Pr units.

The inventive compositions may include at least one fluorosurfactant selected from nonionic fluorosurfactants, cationic fluorosurfactants, and mixtures thereof which are soluble or dispersible in the aqueous compositions being taught herein, sometimes compositions which do not include further detersive surfactants, or further organic solvents, or both. Suitable nonionic fluorosurfactant compounds are found among the materials presently commercially marketed under the tradename Fluorad® (ex. 3M Corp.) Exemplary fluorosurfactants include those sold as Fluorad® FC-740, generally described to be fluorinated alkyl esters; Fluorad® FC-430, generally described to be fluorinated alkyl esters; Fluorad® FC-431, generally described to be fluorinated alkyl esters; and, Fluorad® FC-170-C, which is generally described as being fluorinated alkyl polyoxyethlene ethanols.

An example of a suitable cationic fluorosurfactant compound has the following structure: $C_nF_{2n+1}SO_2NHC3H_6N^+(CH_3)_3I^-$ where n~8. This cationic fluorosurfactant is available under the tradename Fluorad® FC-135 from 3M. Another example of a suitable cationic fluorosurfactant is $F_3$—$(CF_2)_n$—$(CH_2)_m$$SCH_2CHOH$—$CH_2$—$N^+R_1R_2R_3\ Cl^-$ wherein: n is 5–9 and m is 2, and $R_1$, $R_2$ and $R_3$ are —$CH_3$. This cationic fluorosurfactant is available under the tradename ZONYL® FSD (available from DuPont, described as 2-hydroxy-3-((gamma-omega-perfluoro-$C_{6-20}$-alkyl)thio)-N,N,N-trimethyl-1-propyl ammonium chloride). Other cationic fluorosurfactants suitable for use in the present invention are also described in EP 866,115 to Leach and Niwata.

The fluorosurfactant selected from the group of nonionic fluorosurfactant, cationic fluorosurfactant, and mixtures thereof may be present in amounts of from 0.001 to 5% wt., preferably from 0.01 to 1% wt., and more preferably from 0.01 to 0.5% wt.

Solvents with Less than 20% Water Solubility

One aspect of the invention is a solvent with less than 20% solubility in water. Solvents with less than 20% solubility in water include the glycol ether solvents; propylene glycol n-butyl ether, dipropylene glycol n-butyl ether, dipropylene glycol n-propyl ether, and ethylene glycol n-hexyl ether. Also, included are essentially water insoluble solvents such as hydrocarbons and terpenes. Suitable solvents with less than 20% solubility in water can be present in from 0.1 to 10% by weight, or from 1 to 10% by weight.

Volatile Solvents Miscible in Water

One aspect of the invention is a volatile solvent that is miscible in water. These solvents tend to volatilize off after application and not form multiple phases that can lead to enhanced filming and streaking. The volatile solvent can have a vapor pressure greater than 10 mm Hg at 20° C. The volatile solvent can have a vapor pressure greater than 1 mm Hg at 20° C. The solvent should be completely miscible in water. Examples of solvents that have a vapor pressure greater than 1 mm Hg at 20° C. and that are completely miscible in water are listed in Table II. Compositions can contain 0.1 to 10% by weight of volatile solvents that are miscible in water/

TABLE II

| Water miscible solvents | Vapor pressure Mm Hg (20° C.) | Bp ° C. | Surface tension dynes/cm (25° C.) | Specific Heat cal/g K (25° C.) |
|---|---|---|---|---|
| Ethanol | 43 | 78 | 22.3 | 0.618 |
| Isopropanol | 33 | 82.4 | | 0.65 |
| 1,2-Propylene glycol | 0.07 | 187.3 | 40.1 | 0.590 |
| Propylene glycol methyl ether | 8.1 | 120.1 | 27 | 0.58 |
| Propylene glycol ethyl ether | 4.4 | 133 | 29.7 | 0.55 |
| Propylene glycol n-propyl ether | 1.8 | 150 | 27.0 | 0.55 |
| Dipropylene glycol methyl ether | 0.17 | 188 | 29.0 | 0.53 |
| Ethylene glycol methyl ether | 6.2 | 124 | 30.8 | 0.53 |
| Ethylene glycol ethyl ether | 3.8 | 134 | 29.3 | 0.56 |
| Ethylene glycol n-propyl ether | 1.3 | 149 | 27.9 | |
| Ethylene glycol n-butyl ether | 0.6 | 169 | 26.6 | 0.56 |
| Diethylene glycol methyl ether | 0.2 | 191 | 34.8 | 0.54 |
| Diethylene glycol ethyl ether | 0.12 | 198 | 32.2 | 0.55 |

Solvent

Suitable organic solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. The solvents can be present at a level of from 0.001% to 10%, or from 0.01% to 10%, or from 1% to 4% by weight.

Additional Adjuncts

The cleaning compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA). The mildewstat or bacteriostat includes, but is not limited to, mildewstats (including non-isothiazolone compounds) include Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G.

Antimicrobial Agent

Antimicrobial agents, in addition to 2-hydroxycarboxylic acids and other ingredients, include quaternary ammonium compounds and phenolics. Non-limiting examples of these quaternary compounds include benzalkonium chlorides and/or substituted benzalkonium chlorides, di($C_6$–$C_{14}$)alkyl di short chain ($C_{1-4}$ alkyl and/or hydroxyalkl) quaternaryammonium salts, N-(3-chloroallyl)hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethyl-nzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class.

Builder/Buffer

The cleaning composition may include a builder or buffer, which increase the effectiveness of the surfactant. The builder or buffer can also function as a softener and/or a sequestering agent in the cleaning composition. A variety of builders or buffers can be used and they include, but are not limited to, phosphate-silicate compounds, zeolites, alkali metal, ammonium and substituted ammonium poly-etates, trialkali salts of nitrilotriacetic acid, carboxylates, polycarboxylates, carbonates, bicarbonates, polyphosphates, aminopolycarboxylates, polyhydroxy-sulfonates, and starch derivatives.

Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl) amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other preferred pH adjusting agents include sodium or potassium hydroxide.

When employed, the builder, buffer, or pH adjusting agent comprises at least about 0.001% and typically about 0.01–5% of the cleaning composition. Preferably, the builder or buffer content is about 0.01–2%.

Pine Oil, Terpene Derivatives and Essential Oils

Compositions according to the invention may comprise pine oil, terpene derivatives and/or essential oils. Pine oil, terpene derivatives and essential oils are used primarily for cleaning efficacy. They may also provide some antimicrobial efficacy and deodorizing properties. Pine oil, terpene derivatives and essential oils may be present in the compositions in amounts of up to about 1% by weight, preferably in amounts of 0.01% to 0.5% by weight.

Pine oil is a complex blend of oils, alcohols, acids, esters, aldehydes and other organic compounds. These include terpenes that include a large number of related alcohols or ketones. Some important constituents include terpineol. One type of pine oil, synthetic pine oil, will generally contain a higher content of turpentine alcohols than the two other grades of pine oil, namely steam distilled and sulfate pine oils. Other important compounds include alpha- and beta-pinene (turpentine), abietic acid (rosin), and other isoprene derivatives. Particularly effective pine oils are commercially available from Mellennium Chemicals, under the Glidco tradename. These pine oils vary in the amount of terpene alcohols and alpha-terpineol.

Terpene derivatives appropriate for use in the inventive composition include terpene hydrocarbons having a functional group, such as terpene alcohols, terpene ethers, terpene esters, terpene aldehydes and terpene ketones. Examples of suitable terpene alcohols include verbenol, transpinocarveol, cis-2-pinanol, nopol, isoborneol, carbeol, piperitol, thymol, alpha-terpineol, terpinen-4-ol, menthol, 1,8-terpin, dihydro-terpineol, nerol, geraniol, linalool, citronellol, hydroxycitronellol, 3,7-dimethyl octanol, dihydromyrcenol, tetrahydro-alloocimenol, perillalcohol, and falcarindiol. Examples of suitable terpene ether and terpene ester solvents include 1,8-cineole, 1,4-cineole, isobornyl methylether, rose pyran, mentho furan, trans-anethole, methyl chavicol, allocimene diepoxide, limonene monoepoxide, isobornyl acetate, nonyl acetate, terpinyl acetate, linalyl acetate, geranyl acetate, citronellyl acetate, dihydroterpinyl acetate and meryl acetate. Further, examples of suitable terpene aldehyde and terpene ketone solvents include myrtenal, campholenic aldehyde, perillaldehyde, citronellal, citral, hydroxy citronellal, camphor, verbenone, carvenone, dihydro-carvone, carvone, piperitone, menthone, geranyl acetone, pseudo-ionone, ionine, iso-pseudo-methyl ionone, n-pseudo-methyl ionone, iso-methyl ionone and n-methyl ionone.

Essential oils include, but are not limited to, those obtained from thyme, lemongrass, citrus, lemons, oranges, anise, clove, aniseed, pine, cinnamon, geranium, roses, mint, lavender, citronella, eucalyptus, peppermint, camphor, sandalwood, rosmarin, vervain, fleagrass, lemongrass, ratanhiae, cedar and mixtures thereof. Preferred essential oils to be used herein are thyme oil, clove oil, cinnamon oil, geranium oil, eucalyptus oil, peppermint oil, mint oil or mixtures thereof.

Actives of essential oils to be used herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, ferulic acid, cinnamic acid, methyl salycilic acid, methyl salycilate, terpineol and mixtures thereof. Preferred actives of essential oils to be used herein are thymol, eugenol, verbenone, eucalyptol, terpineol, cinnamic acid, methyl salycilic acid, and/or geraniol.

Other essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Bomeol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methhyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen. Each of these botanical oils is commercially available.

Particularly preferred oils include peppermint oil, lavender oil, bergamot oil (Italian), rosemary oil (Tunisian), and sweet orange oil. These may be commercially obtained from a variety of suppliers including: Givadan Roure Corp. (Clifton, N.J.); Berje Inc. (Bloomfield, N.J.); BBA Aroma Chemical Div. of Union Camp Corp. (Wayne, N.J.); Firmenich Inc. (Plainsboro N.J.); Quest International Fragrances Inc. (Mt. Olive Township, N.J.); Robertet Fragrances Inc. (Oakland, N.J.).

Particularly useful lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit.

Polymers

In preferred embodiments of the invention, polymeric material that improves the hydrophilicity of the surface being treated is incorporated into the present compositions. The increase in hydrophilicity provides improved final appearance by providing "sheeting" of the water from the surface and/or spreading of the water on the surface, and this effect is preferably seen when the surface is rewetted and even when subsequently dried after the rewetting. Polymer substantivity is beneficial as it prolongs the sheeting and cleaning benefits. Another important feature of preferred polymers is lack of visible residue upon drying. In preferred embodiments, the polymer comprises 0.001 to 5%, preferably 0.01 to 1%, and most preferably 0.1 to 0.5% of the cleaning composition.

Nanoparticles

Nanoparticles, defined as particles with diameters of about 400 nm or less, are technologically significant, since they are utilized to fabricate structures, coatings, and devices that have novel and useful properties due to the very small dimensions of their particulate constituents. "Non-photoactive" nanoparticles do not use UV or visible light to produce the desired effects. Nanoparticles can have many different particle shapes. Shapes of nanoparticles can include, but are not limited to spherical, parallelpiped-shaped, tube shaped, and disc or plate shaped. Nanoparticles can be present from 0.01 to 1%.

Inorganic nanoparticles generally exist as oxides, silicates, carbonates and hydroxides. These nanoparticles are generally hydrophilic. Some layered clay minerals and inorganic metal oxides can be examples of nanoparticles. The layered clay minerals suitable for use in the coating composition include those in the geological classes of the smectites, the kaolins, the illites, the chlorites, the attapulgites and the mixed layer clays. Smectites include montmorillonite, bentonite, pyrophyllite, hectorite, saponite, sauconite, nontronite, talc, beidellite, volchonskoite and vermiculite. Kaolins include kaolinite, dickite, nacrite, antigorite, anauxite, halloysite, indellite and chrysotile. Illites include bravaisite, muscovite, paragonite, phlogopite and biotite. Chlorites include corrensite, penninite, donbassite, sudoite, pennine and clinochlore. Attapulgites include sepiolite and polygorskyte. Mixed layer clays include allevardite and vermiculitebiotite. Variants and isomorphic substitutions of these layered clay minerals offer unique applications.

The layered clay minerals suitable for use in the coating composition may be either naturally occurring or synthetic. An example of one embodiment of the coating composition uses natural or synthetic hectorites, montmorillonites and bentonites. Another embodiment uses the hectorites clays commercially available. Typical sources of commercial hectorites are LAPONITE® from Southern Clay Products, Inc., U.S.A; Veegum Pro and Veegum F from R. T. Vanderbilt, U.S.A.; and the Barasyms, Macaloids and Propaloids from Baroid Division, National Read Comp., U.S.A.

The inorganic metal oxides used in the coating composition may be silica- or alumina-based nanoparticles that are naturally occurring or synthetic. Aluminum can be found in many naturally occurring sources, such as kaolinite and bauxite. The naturally occurring sources of alumina are processed by the Hall process or the Bayer process to yield the desired alumina type required. Various forms of alumina are commercially available in the form of Gibbsite, Diaspore, and Boehmite from manufacturers such as Condea.

In some preferred embodiments, the nanoparticles will have a net excess charge on one of their dimensions. For instance, flat plate-shaped nanoparticles may have a positive charge on their flat surfaces, and a negative charge on their edges. Alternatively, such flat plate-shaped nanoparticles may have a negative charge on their flat surfaces and a positive charge on their edges. Preferably, the nanoparticles have an overall net negative charge. This is believed to aid in hydroplilizing the surface coated with the nanoparticles. The amount of charge, or "charge density", on the nanoparticles can be measured in terms of the mole ratio of magnesium oxide to lithium oxide in the nanoparticles. In preferred embodiments, the nanoparticles have a mole ratio of magnesium oxide to lithium oxide of less than or equal to about 11%.

Substances Generally Recognized as Safe

Compositions according to the invention may comprise substances generally recognized as safe (GRAS), including essential oils, oleoresins (solvent-free) and natural extractives (including distillates), and synthetic flavoring materials and adjuvants. Compositions may also comprise GRAS materials commonly found in cotton, cotton textiles, paper and paperboard stock dry food packaging materials (referred herein as substrates) that have been found to migrate to dry food and, by inference may migrate into the inventive compositions when these packaging materials are used as substrates for the inventive compositions.

Suitable GRAS materials are listed in the Code of Federal Regulations (CFR) Title 21 of the United States Food and Drug Administration, Department of Health and Human Services, Parts 180.20, 180.40 and 180.50, which are hereby incorporated by reference. These suitable GRAS materials include essential oils, oleoresins (solvent-free), and natural extractives (including distillates). The GRAS materials may be present in the compositions in amounts of up to about 10% by weight, preferably in amounts of 0.01 and 5% by weight.

Prefered GRAS materials include oils and oleoresins (solvent-free) and natural extractives (including distillates) derived from alfalfa, allspice, almond bitter (free from prussic acid), ambergris, ambrette seed, angelica, angostura (cusparia bark), anise, apricot kernel (persic oil), asafetida, balm (lemon balm), balsam (of Peru), basil, bay leave, bay (myrcia oil), bergamot (bergamot orange), bois de rose (Aniba rosaeodora Ducke), cacao, camomile (chamomile) flowers, cananga, capsicum, caraway, cardamom seed (cardamon), carob bean, carrot, cascarilla bark, cassia bark, Castoreum, celery seed, cheery (wild bark), chervil, cinnamon bark, Civet (zibeth, zibet, zibetum), ceylon (Cinnamomum zeylanicum Nees), cinnamon (bark and leaf), citronella, citrus peels, clary (clary sage), clover, coca (decocainized), coffee, cognac oil (white and green), cola nut (kola nut), coriander, cumin (cummin), curacao orange peel, cusparia bark, dandelion, dog grass (quackgrass, triticum), elder flowers, estragole (esdragol, esdragon, estragon, tarragon), fennel (sweet), fenugreek, galanga (galangal), geranium, ginger, grapefruit, guava, hickory bark, horehound (hoarhound), hops, horsemint, hyssop, immortelle (Helichrysum augustifolium DC), jasmine, juniper (berries), laurel berry and leaf, lavender, lemon, lemon grass, lemon peel, lime, linden flowers, locust bean, lupulin, mace, mandarin (Citrus reticulata Blanco), marjoram, mate, menthol (including menthyl acetate), molasses (extract), musk (Tonquin musk), mustard, naringin, neroli (bigarade), nutmeg, onion, orange (bitter, flowers, leaf, flowers, peel), origanum, palmarosa, paprika, parsley, peach kernel (persic oil, pepper (black, white), peanut (stearine), peppermint, Peruvian balsam, petitgrain lemon, petitgrain mandarin (or tangerine), pimenta, pimenta leaf, pipsissewa leaves, pomegranate, prickly ash bark, quince seed, rose (absolute, attar, buds, flowers, fruit, hip, leaf), rose geranium, rosemary, safron, sage, St. John's bread, savory, schinus molle (Schinus molle L), sloe berriers, spearmint, spike lavender, tamarind, tangerine, tarragon, tea (Thea sinensis L.), thyme, tuberose, turmeric, vanilla, violet (flowers, leaves), wild cherry bark, ylang—ylang and zedoary bark.

Suitable synthetic flavoring substances and adjuvants are listed in the Code of Federal Regulations (CFR) Title 21 of the United States Food and Drug Administration, Department of Health and Human Services, Part 180.60, which is hereby incorporated by reference. These GRAS materials may be present in the compositions in amounts of up to about 1% by weight, preferably in amounts of 0.01 and 0.5% by weight.

Suitable synthetic flavoring substances and adjuvants that are generally recognized as safe for their intended use, include acetaldehyde (ethanal), acetoin (acetyl methylcarbinol), anethole (parapropenyl anisole), benzaldehyde (benzoic aldehyde), n-Butyric acid (butanoic acid), d- or 1-carvone (carvol), cinnamaldehyde (cinnamic aldehyde), citral (2,6-dimethyloctadien-2,6-al-8, gera-nial, neral), decanal (N-decylaldehyde, capraldehyde, capric aldehyde, caprinaldehyde, aldehyde C-10), ethyl acetate, ethyl butyrate, 3-Methyl-3-phenyl glycidic acid ethyl ester (ethyl-methyl-phenyl-glycidate, so-called strawberry aldehyde, C-16 aldehyde), ethyl vanillin, geraniol (3,7-dimethyl-2,6 and 3,6-octadien-1-ol), geranyl acetate (geraniol acetate), limonene (d-, 1-, and dl-), linalool (linalol, 3,7-dimethyl-1,6-octadien-3-ol), linalyl acetate (bergamol), methyl anthranilate (methyl-2-aminobenzoate), piperonal (3,4-methylenedioxy-benzaldehyde, heliotropin) and vanillin.

Suitable GRAS substances that may be present in the inventive compositions that have been identified as possibly migrating to food from cotton, cotton textiles, paper and paperboard materials used in dry food packaging materials are listed in the Code of Federal Regulations (CFR) Title 21 of the United States Food and Drug Administration, Department of Health and Human Services, Parts 180.70 and 180.90, which are hereby incorporated by reference. The GRAS materials may be present in the compositions either by addition or incidentally owing to migration from the substrates to the compositions employed in the invention, or present owing to both mechanisms. If present, the GRAS materials may be present in the compositions in amounts of up to about 1% by weight.

Suitable GRAS materials that are suitable for use in the invention, identified as originating from either cotton or cotton textile materials used as substrates in the invention, include beef tallow, carboxymethylcellulose, coconut oil (refined), cornstarch, gelatin, lard, lard oil, oleic acid, peanut oil, potato starch, sodium acetate, sodium chloride, sodium silicate, sodium tripolyphosphate, soybean oil (hydrogenated), talc, tallow (hydrogenated), tallow flakes, tapioca starch, tetrasodium pyrophosphate, wheat starch and zinc chloride.

Suitable GRAS materials that are suitable for use in the invention, identified as originating from either paper or paperboard stock materials used as substrates in the invention, include alum (double sulfate of aluminum and ammonium potassium, or sodium), aluminum hydroxide, aluminum oleate, aluminum palmitate, casein, cellulose acetate, cornstarch, diatomaceous earth filler, ethyl cellulose, ethyl vanillin, glycerin, oleic acid, potassium sorbate, silicon dioxides, sodium aluminate, sodium chloride, sodium hexametaphosphate, sodium hydrosulfite, sodium phospho-aluminate, sodium silicate, sodium sorbate, sodium tripolyphosphate, sorbitol, soy protein (isolated), starch (acid modified, pregelatinized and unmodified), talc, vanillin, zinc hydrosulfite and zinc sulfate.

Fragrance

Compositions of the present invention may comprise from about 0.01% to about 50% by weight of the fragrance oil. Compositions of the present invention may comprise from about 0.2% to about 25% by weight of the fragrance oil. Compositions of the present invention may comprise from about 1% to about 25% by weight of the fragrance oil.

As used herein the term "fragrance oil" relates to the mixture of perfume raw materials that are used to impart an overall pleasant odor profile to a composition. As used herein the term "perfume raw material" relates to any chemical compound which is odiferous when in an unentrapped state, for example in the case of pro-perfumes, the perfume component is considered, for the purposes of this invention, to be a perfume raw material, and the pro-chemistry anchor is considered to be the entrapment material. In addition "perfume raw materials" are defined by materials with a ClogP value preferably greater than about 0.1, more preferably greater than about 0.5, even more preferably greater than about 1.0. As used herein the term "ClogP" means the logarithm to base 10 of the octanol/water partition coefficient. This can be readily calculated from a program called "CLOGP" which is available from Daylight Chemical Information Systems Inc., Irvine Calif., U.S.A. Octanol/water partition coefficients are described in more detail in U.S. Pat. No. 5,578,563.

Water

When the composition is an aqueous composition, water can be, along with the solvent, a predominant ingredient. The water should be present at a level of less than 99.9%, more preferably less than about 99%, and most preferably, less than about 98%. Deionized water is preferred. Where the cleaning composition is concentrated, the water may be present in the composition at a concentration of less than about 85 wt. %.

Cleaning Substrate

The cleaning composition may be part of a cleaning substrate. A wide variety of materials can be used as the cleaning substrate. The substrate should have sufficient wet strength, abrasivity, loft and porosity. Examples of suitable substrates include, nonwoven substrates, wovens substrates, hydroentangled substrates, foams and sponges. Any of these substrates may be water-insoluble, water-dispersible, or water-soluble.

In one embodiment, the cleaning pad of the present invention comprises a nonwoven substrate or web. The substrate is composed of nonwoven fibers or paper. The term nonwoven is to be defined according to the commonly known definition provided by the "Nonwoven Fabrics Handbook" published by theAssociation of the Nonwoven Fabric Industry. A paper substrate is defined by EDANA (note 1 of ISO 9092-EN 29092) as a substrate comprising more than 50% by mass of its fibrous content is made up of fibers (excluding chemically digested vegetable fibers) with a length to diameter ratio of greater than 300, and more preferably also has density of less than 0.040 g/cm$^3$. The definitions of both nonwoven and paper substrates do not include woven fabric or cloth or sponge. The substrate can be partially or fully permeable to water. The substrate can be flexible and the substrate can be resilient, meaning that once applied external pressure has been removed the substrate regains its original shape.

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber-laden air or water is passed. The air-laying process is described in U.S. Pat. App. 2003/0036741 to Abba et al. and U.S. Pat. App. 2003/0118825 to Melius et al. The resulting layer, regardless of its method of production or composition, is then subjected to at least one of several types of bonding operations to anchor the individual fibers together to form a self-sustaining substrate. In the present invention the nonwoven substrate can be prepared by a variety of processes including, but not limited to, air-entanglement, hydroentanglement, thermal bonding, and combinations of these processes.

Additionally, the first layer and the second layer, as well as additional layers, when present, can be bonded to one another in order to maintain the integrity of the article. The layers can be heat spot bonded together or using heat generated by ultrasonic sound waves. The bonding may be arranged such that geometric shapes and patterns, e.g. diamonds, circles, squares, etc. are created on the exterior surfaces of the layers and the resulting article.

The cleaning substrates can be provided dry, pre-moistened, or impregnated with cleaning composition, but dry-to-the-touch. In one aspect, dry cleaning substrates can be provided with dry or substantially dry cleaning or disinfecting agents coated on or in the multicomponent multilobal fiber layer. In addition, the cleaning substrates can be provided in a pre-moistened and/or saturated condition. The wet cleaning substrates can be maintained over time in a sealable container such as, for example, within a bucket with an attachable lid, sealable plastic pouches or bags, canisters, jars, tubs and so forth. Desirably the wet, stacked cleaning substrates are maintained in a resealable container. The use of a resealable container is particularly desirable when using volatile liquid compositions since substantial amounts of liquid can evaporate while using the first substrates thereby leaving the remaining substrates with little or no liquid. Exemplary resealable containers and dispensers include, but are not limited to, those described in U.S. Pat. No. 4,171,047 to Doyle et al., U.S. Pat. No. 4,353,480 to McFadyen, U.S. Pat. No. 4,778,048 to Kaspar et al., U.S. Pat. No. 4,741,944 to Jackson et al., U.S. Pat. No. 5,595,786 to McBride et al.; the entire contents of each of the aforesaid references are incorporated herein by reference. The cleaning substrates can be incorporated or oriented in the container as desired and/or folded as desired in order to improve ease of use or removal as is known in the art. The cleaning substrates of the present invention can be provided in a kit form, wherein a plurality of cleaning substrates and a cleaning tool are provided in a single package.

The substrate can include both natural and synthetic fibers. The substrate can also include water-soluble fibers or water-dispersible fibers, from polymers described herein. The substrate can be composed of suitable unmodified and/or modified naturally occurring fibers including cotton, Esparto grass, bagasse, hemp, flax, silk, wool, wood pulp, chemically modified wood pulp, jute, ethyl cellulose, and/or cellulose acetate. Various pulp fibers can be utilized including, but not limited to, thermomechanical pulp fibers, chemi-thermomechanical pulp fibers, chemi-mechanical pulp fibers, refiner mechanical pulp fibers, stone groundwood pulp fibers, peroxide mechanical pulp fibers and so forth.

Suitable synthetic fibers can comprise fibers of one, or more, of polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like, including fibers comprising polymers containing more than one monomer.

The cleaning substrate of this invention may be a multilayer laminate and may be formed by a number of different techniques including but not limited to using adhesive, needle punching, ultrasonic bonding, thermal calendering and through-air bonding. Such a multilayer laminate may be an embodiment wherein some of the layers are spunbond and some meltblown such as a spunbond/meltblown/spunbond (SMS) laminate as disclosed in U.S. Pat. No. 4,041,203 to Brock et al. and U.S. Pat. No. 5,169,706 to Collier, et al., each hereby incorporated by reference. The SMS laminate may be made by sequentially depositing onto a moving conveyor belt or forming wire first a spunbond web layer, then a meltblown web layer and last another spunbond layer and then bonding the laminate in a manner described above. Alternatively, the three web layers may be made individually, collected in rolls and combined in a separate bonding step.

The substrate may also contain superabsorbent materials. A wide variety of high absorbency materials (also known as superabsorbent materials) are known to those skilled in the art. See, for example, U.S. Pat. No. 4,076,663 issued Feb. 28, 1978 to Masuda et al, U.S. Pat. No. 4,286,082 issued Aug. 25, 1981 to Tsubakimoto et al., U.S. Pat. No. 4,062,817 issued Dec. 13, 1977 to Westerman, and U.S. Pat. No. 4,340,706 issued Jul. 20, 1982 to Obayashi et al. The absorbent capacity of such high-absorbency materials is generally many times greater than the absorbent capacity of fibrous materials. For example, a fibrous matrix of wood pulp fluff can absorb about 7–9 grams of a liquid, (such as 0.9 weight percent saline) per gram of wood pulp fluff, while the high-absorbency materials can absorb at least about 15, preferably at least about 20, and often at least about 25 grams of liquid, such as 0.9 weight percent saline, per gram of the high-absorbency material. U.S. Pat. No. 5,601,542, issued to Melius et al., discloses an absorbent article in which superabsorbent material is contained in layers of discrete pouches. Alternately, the superabsorbent material may be within one layer or dispersed throughout the substrate.

Cleaning Implement

In an embodiment of the invention, the cleaning composition may be used with a cleaning implement. In an embodiment of the invention, the cleaning implement comprises the tool assembly disclosed in Co-pending application Ser. No. 10/678,033, entitled "Cleaning Tool with Gripping Assembly for a Disposable Scrubbing Head", filed Sep. 30, 2003. In another embodiment of the invention, the cleaning implement comprises the tool assembly disclosed in Co-pending application Ser. No. 10/602,478, entitled "Cleaning Tool with Gripping Assembly for a Disposable Scrubbing Head", filed Jun. 23, 2003. In another embodiment of the invention, the cleaning implement comprises the tool assembly disclosed in Co-pending application Ser. No. 10/766,179, entitled "Interchangeable Tool Heads", filed Jan. 27, 2004. In another embodiment of the invention, the cleaning implement comprises the tool assembly disclosed in Co-pending application Ser. No. 10/817,606, entitled "Ergonomic Cleaning Pad", filed Apr. 1, 2004. In another embodiment of the invention, the cleaning implement comprises the tool assembly disclosed in Co-pending Application No. 10/850,213, entitled "Locking, Segmented Cleaning Implement Handle", filed May 19, 2004.

In another embodiment of the invention, the cleaning implement comprises an elongated shaft having a handle portion on one end thereof. The tool assembly may further include a gripping mechanism that is mounted to the shaft to engage the removable cleaning pad. Examples of suitable cleaning implements are found in US2003/0070246 to Cavalheiro; U.S. Pat. No. 4,455,705 to Graham; U.S. Pat. No. 5,003,659 to Paepke; U.S. Pat. No. 6,485,212 to Bomgaars et al.; U.S. Pat. No. 6,290,781 to Brouillet, Jr.; U.S. Pat. No. 5,862,565 to Lundstedt; U.S. Pat. No. 5,419,015 to Garcia; U.S. Pat. No. 5,140,717 to Castagliola; U.S. Pat. No. 6,611,986 to Seals; US2002/0007527 to Hart; and U.S. Pat. No. 6,094,771 to Egolf et al. The cleaning implement may have a hook, hole, magnetic means, canister or other means to allow the cleaning implement to be conveniently stored when not in use.

EXAMPLES

Compositions were tested for antimicrobial activity and are shown in Table III, with ingredients given in % active by weight and relative antimicrobial activity on *Staphylococcus aureus* followed by *Salmonella chloreraesuis* given in percent.

TABLE III

| | A | B | Comparative A | Comparative B |
|---|---|---|---|---|
| Lactic Acid | 3 | 3 | 3 | 3 |
| Ethanol | 1 | 3 | 3 | 3 |
| Propylene glycol n-butyl ether[a] | 3 | 1 | | |
| Quaternary surfactant[b] | 0.005 | 0.005 | | |
| Sodium lauryl sulfate[c] | | | 0.2 | |
| Polyoxyethylene (20) sorbitan monolaurate[d] | 2 | 2 | 2 | |
| Sucrose cocoate[e] | | | | 2 |
| Relative antimicrobial activity | 67<br>100 | 9<br>58 | 0<br>0 | 0<br>16 |

[a]Dowanol PnB ® from Dow Chemical
[b]Barquat 4250Z ® from Lonza
[c]Stepanol WAC ® from Stepan Chemical
[d]Tween 20 ® from Uniquema
[e]Crodesta SL-40 ® from Croda Filming and Streaking The compositions of the invention were tested for residue by evaluating filming and streaking on four by four inch black ceramic tile. First, 0.6 g of solution was placed on the tile, and the tile was wiped across four times with a paper towel. The tile was then evaluated visually for filhing and streaking on a scale of 1 to 10 (1=good and 10=bad) and the results are given in Table IV below with ingredients in % by weight active and the balance water.

TABLE IV

| | C | D | E | F | G | H | I | J | K |
|---|---|---|---|---|---|---|---|---|---|
| Citric acid | | | | | | | 3 | | |
| Lactic acid | 3 | 3 | 3 | 3 | 3 | 3 | | 3 | 3 |
| Ethanol | | | | | 1 | 3 | | | |
| Propylene glycol n-butyl ether | 3 | 3 | 3 | 3 | 3 | 3 | 3 | 1 | 1 |
| Anionic[a] | | 1 | 1.5 | 2 | | | | | |
| Tween 20 ® | 2 | 2 | 2 | 2 | 2 | 2 | 2 | | |
| Sucrose cocoate | | | | | | | | 1 | |
| Polysorbate 80 ®[b] | | | | | | | | | 1 |
| Filming/Streaking | 3 | 5 | 8 | 8 | 1 | 1 | 1 | 1 | 2 |

[a]Stepanol WAC ® from Stepan Chemical
[b]Polyoxyethylene (20) sorbitan monooleate from J. T. Baker Additional examples are given in Table V below.

TABLE IV

| | L | M | N | O |
|---|---|---|---|---|
| Tween 20 ® | | 10 | | |
| Alkyl polyglycoside[a] | 2 | | 3 | |
| Alcohol ethoxylate[b] | | | | 1.0 |
| Amonic[c] | 0.5 | 1 | | |
| Quat[d] | | | 0.1 | |
| Amphoteric[e] | | | | 0.1 |
| Citric acid | 10 | | | 3 |
| Lactic acid | | 20 | 1 | |
| Isopropanol | 3 | | 3 | 3 |
| Propylene glycol n-butyl ether | | 10 | 1 | 2 |
| Dipropylene glycol n-butyl ether[f] | 0.1 | | | |
| d-limonene | | 0.2 | | |
| Tea Tree Oil[g] | 0.1 | | | |
| Blue Dye | | | | 0.006 |
| Fragrance | | | | 0.2 |

[a]APG 325N ® from Cognis
[b]Alfonic 1012-5 ® from Vista Chemical
[c]Sodium dodecyl diphenyloxide disulfonate, Dowfax 2A1 ® from Dow Chemical
[d]Barquat 4250Z ® from Lonza
[e]Cetyl betaine from Stepan
[f]Dowanol DPnB ® from Dow Chemical
[g]Lemon Scented Tea Tree Oil from Down Under Enterprises These compositions can be used as impregnated in substrates, for example those substrates as described in U.S. Pat. No. 6,841,527 to Mitra et al.; U.S. Pat. No. 6,340,663 to Deleo et al.; U.S. Pat. App. 20050055787 to Blum et al.; and U.S. patent application Ser. No. 10/882,001 to Kilkenny et al. For example, Composition C in Table IV can be impregnated in DuPont 8838 with a loading ratio of 3.75:1 as described in U.S. Pat. No. 6,841,527 to Mitra et al. In one example a composition comprising 3% propylene glycol n-butyl ether, 2% Tween 20®, 3% lactic acid, and 1% ethanol (pH 2.0–2.5) was loaded onto a nonwoven substrate and tested for antimicrobial activity against *Staphylococcus aureus*. The composition has a positive antimicrobial effect both as a solution and when impregnated in the nonwoven substrate.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A hard surface cleaning composition comprising:

a. greater than 1% by weight lactic acid;

b. 0 to 10% by weight anionic surfactant;

c. 0.1 to 10% by weight nonionic surfactant;

d. 0.1 to 10% by weight of a solvent with less than 20% solubility in water; and e. 0.1 to 10% by weight of a water miscible solvent with a vapor pressure greater than 1 mm Hg at 20° C.;

f. wherein said nonionic surfactant comprises sorbitan esters or a combination of sorbitan esters and sucrose esters g. wherein the ratio of anionic surfactant to nonionic surfactant is less than 0.5; and h. wherein the ratio of solvent with less than 20% solubility in water to water miscible solvent is 1.0 or less.

2. The composition of claim 1 comprising 0.1 to 10% of said anionic surfactant and wherein said anionic surfactant comprises a surfactant selected from the group consisting of alkyl sulfates, alkyl disulfonates, alkyl benzene sulfonates, and combinations thereof.

3. The composition of claim 1, wherein said solvent with less than 20% solubility in water is a glycol ether.

4. The composition of claim 1, wherein said composition comprises 1 to 10% by weight of a solvent with less than 20% solubility in water.

5. The composition of claim 1, wherein said nonionic surfactant comprises a sorbitan ester.

6. The composition of claim 1, wherein said composition additionally comprises an essential oil.

7. The composition of claim 1, wherein said composition is free of quaternary ammonium surfactants.

8. The composition of claim 1, wherein said composition has a pH of 7 or less.

9. The composition of claim 1, wherein said composition impregnates a porous or absorbent nonwoven sheet.

10. A cleaning composition comprising:

a. 1 to 20% by weight lactic acid;

b. 0.1 to 10% by weight of a nonionic surfactant, wherein said nonionic surfactant is food safe;

c. 0.05 to 5% by weight of an anionic surfactant;

d. 0.1 to 10% by weight of a water miscible solvent with a vapor pressure greater than 1 mm Hg at 20° C.; and e. 0.1 to 10% by weight of a solvent with less than 20% solubility in water;

f. wherein the ratio of solvent with less than 20% solubility in water to water miscible solvent is 1.0 or less;

g. wherein said nonionic surfactant comprises a surfactant selected from the group consisting of sucrose esters sorbitan esters and combinations thereof; and h. wherein the ratio of said anionic surfactant to said nonionic surfactant is less than 0.5.

11. The composition of claim 10, wherein said composition has a pH of 7 or less.

12. The composition of claim 10, wherein said composition impregnates a porous or absorbent nonwoven sheet.

13. The composition of claim 10, wherein said nonionic surfactant comprises a sucrose ester.

14. A cleaning substrate impregnated with a cleaning composition comprising a. 1 to 10% by weight lactic acid;

b. 0.1 to 10% by weight of a nonionic surfactant;

c. 0 to 10% by weight of an anionic surfactant;

d. 0.1 to 3% by weight of a water miscible solvent with a vapor pressure greater than 1 mm Hg at 20° C.; and e. 0.1 to 10% by weight of a solvent with less than 20% solubility in water;

f. wherein the ratio of solvent with less than 20% solubility in water to water miscible solvent is 1.0 or less;

g. wherein said nonionic surfactant comprises sorbitan esters or a combination of sorbitan esters and sucrose esters; and h. wherein the ratio of said anionic surfactant to said nonionic surfactant is less than 0.5.

15. The composition of claim 10, wherein said nonionic surfactant comprises a sorbitan ester.

16. The substrate of claim 14 comprising 0.1 to 10% of said anionic surfactant.

* * * * *